US005801647A

United States Patent [19]

Survo et al.

[11] Patent Number: 5,801,647

[45] Date of Patent: Sep. 1, 1998

[54] METHOD AND APPARATUS FOR MEASURING ROAD SURFACE CONDITIONS

[75] Inventors: Petteri Survo; Taisto Haavasoja, both of Helsinki, Finland

[73] Assignee: Vaisala Oy, Helsinki, Finland

[21] Appl. No.: 706,715

[22] Filed: Sep. 6, 1996

[30] Foreign Application Priority Data

Sep. 8, 1995 [FI] Finland ..... 954198

[51] Int. Cl.[6] ..... G08B 21/00

[52] U.S. Cl. ..... 340/905; 340/580; 340/583; 340/604; 250/574

[58] Field of Search ..... 340/905, 580, 340/581, 583, 604, 962; 250/573, 574

[56] References Cited

U.S. PATENT DOCUMENTS

| | | | |
|---|---|---|---|
| 3,045,223 | 7/1962 | Kapany et al. | 340/583 |
| 4,690,553 | 9/1987 | Fukamizu et al. | 356/51 |
| 4,782,331 | 11/1988 | Martens | 340/583 |
| 4,797,660 | 1/1989 | Rein, Jr. | 340/583 |
| 4,851,817 | 7/1989 | Brossia et al. | 340/583 |
| 4,897,597 | 1/1990 | Whitener | 340/580 |
| 5,005,005 | 4/1991 | Brossia et al. | 340/583 |
| 5,596,320 | 1/1997 | Barnes | 370/583 |

FOREIGN PATENT DOCUMENTS

| | | |
|---|---|---|
| 0099023 | 7/1982 | European Pat. Off. . |
| 1582673 | 2/1978 | United Kingdom . |
| 2158939 | 5/1984 | United Kingdom . |
| 2212913 | 11/1988 | United Kingdom . |

*Primary Examiner*—Edward Lefkowitz
*Attorney, Agent, or Firm*—Birch, Stewart, Kolasch & Birch, LLP

[57] ABSTRACT

The present invention relates to a method and apparatus for measuring road surface conditions. In the method of measuring road surface conditions, the conditions prevailing on the surface of a road are measured by a sensor head mounted in the pavement of the road with the top surface of the sensor head aligned substantially flush with the pavement of the road. According to the invention, an optical signal is impinged from below the road to the top surface of the road, the reflection/backscatter of the optical signal is measured inside the pavement layer of the road, and weather/driving conditions prevailing on the road top surface are determined from the reflected and backscattered signal values.

16 Claims, 4 Drawing Sheets

FIG. 1b
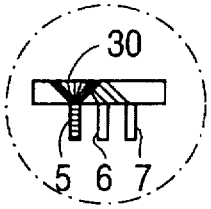
FIG. 1a
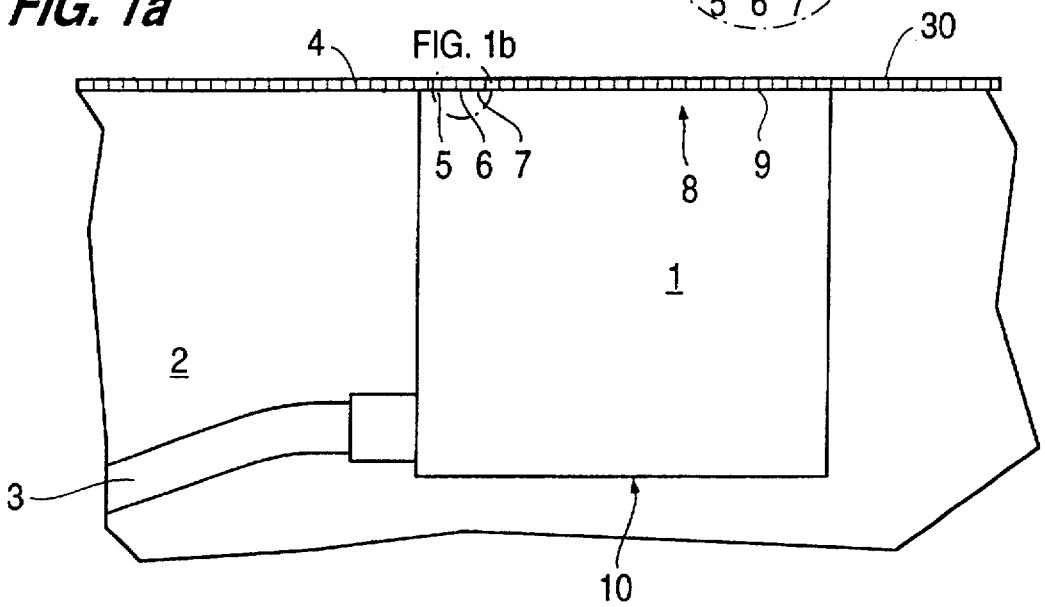
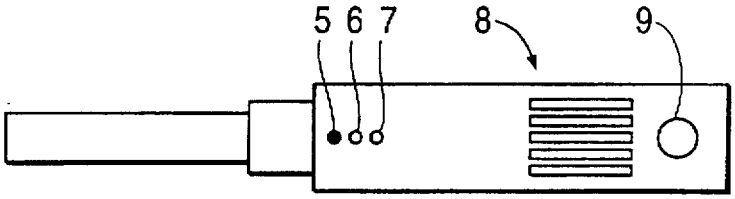
FIG. 2
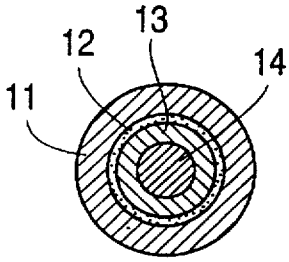
FIG. 3
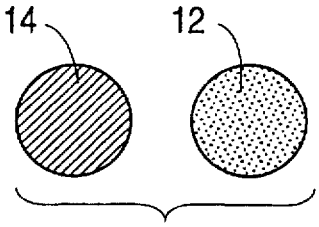
FIG. 4

METHOD AND APPARATUS FOR MEASURING ROAD SURFACE CONDITIONS

BACKGROUND OF INVENTION

1. Field of the Invention

The present invention relates to an apparatus and method thereof for measuring road surface conditions with a fiber optic transmitter and receiver.

Measurement equipment for road surface conditions is intended for unattended measurement of road surface variables thus improving traffic safety and aiding the allocation of road maintenance resources. The task of the measurement equipment is to gather maximally reliable information on the type, characteristics and quantities of the covering of precipitation prevailing on the road surface. For instance, early warnings of road surface freezing conditions form an important sector of the tasks performed by road condition measurement equipment.

2. Description of Background Art

According to conventional techniques, road surface conditions are measured by means of sensors mounted in the road surface, whereby information on the road surface conditions such as temperature, temperature rate-of-change and electrical conductivity of the precipitation covering on the road surface is gathered using capacitive and resistive sensors. The road surface sensors may also be provided with heater elements.

A weakness of electrical sensors has been in unreliable measurement under conditions in which the electrical conductivity of the road top surface has dropped to a low value. This occurs in situations where the pavement is covered by an exceptionally thin film of salty water or under heavy rain, whereby the water layer is thick but its electrolyte concentration is minimal.

Remote-sensing measurement equipment based on detecting road surface conditions from the reflection and absorption characteristics of the pavement have been developed utilizing various methods including microwave and near-infrared optical sensing techniques. The results thus obtained have been most promising in the measurement of water layer thickness, salinity of the water film as well as the state of the moisture covering the pavement. However, remote-sensing systems are rather complicated and incapable of sensing of road surface temperature reliably. Ultrasonic techniques have in some cases been implemented in water/ice layer thickness measuring sensors with a flush-mountable design for mounting in the pavement. The ultrasonic method is based on detecting the phase difference between the reflections from emitting sensor surface, which is flush-mounted in the pavement, and the water-air or ice-air interface, respectively. Using this method, it has been possible to measure water layer thickness from one millimeter upward with an inaccuracy of ±0.25 mm. However, the most common and most important water layer thicknesses for computation of water salinity are in the order of tenths of a millimeter only. The freezing point depression of moisture on the road surface can be determined either indirectly by concentration measurement of salt solution on the road or directly using an active cooling element combined with temperature measurement. The operation of these so-called thermally active road surface condition sensors is based on active cooling of the road surface until the freezing of the water film is detected by an electrical conductivity measurement. Simultaneous temperature measurement of the thus formed ice gives the freezing point depression of the water film. Subsequently, the road surface is allowed to warm and the measurement is repeated after the sensor environment has regained its steady state. Typically, the efficiency of the cooling effect implemented by means of a Peltier element is only in the order of 50%, whereby the heat dissipated by the cooling element can disturb the temperature measurement to some degree as well as distort the actual conditions of the road surface.

SUMMARY OF THE INVENTION

It is an object of the present invention to overcome the drawbacks of the above-described techniques and to provide an entirely novel type of method and apparatus for measuring road surface conditions.

The goal of the invention is accomplished by emitting from a sensor, which is mounted in the road pavement, an optical signal upward toward the top surface of the road, whereby at least two returning optical signals reflected from the road surface covering layer are measured.

These and other objects of the present invention are fulfilled by a method of measuring conditions of a road surface comprising: transmitting an optical signal from a fiber optic transmitter inside a sensor head through a medium outside the fiber optic transmitter adjacent the road surface, said sensor head being aligned substantially flush with the road surface; receiving reflection and back scatter of the optical signal moving from a surface of and through the medium spaced above the road surface by a plurality of fiber optic receivers inside said sensor head; and calculating at least one of weather and driving conditions prevailing on the road surface from the reflected and back scatter optical signal received from said plurality of fiber optic receivers.

In addition, these and other object of the present invention are also fulfilled by the apparatus for measuring the conditions of a road surface, said apparatus comprising: a sensor head mounted in pavement material beneath the road surface with a surface of the sensor head aligned substantially flush with the road surface, said sensor head includes at least one fiber-optic transmitter emitting an optical signal from below the road surface and through a medium adjacent to the road surface, the medium including a surface spaced apart from the road surface, said sensor head further includes at least two fiber-optic receivers receiving the optical signal reflected or back scattered from the surface of the medium spaced apart from the road surface.

The invention offers significant benefits over conventional techniques.

The present fiber-optic measurement method gives essential complementary information particularly under winter conditions of the road surface where conventional sensor types fail to operate with sufficient reliability in the detection of dry snow and slush. The sensor according to the invention also gives good results under conditions when the road surface is covered with a thick water layer, or alternatively, with a thin, low-salinity water film of 0.1–0.2 mm thickness. Moreover, a fiber-optic sensor offers high mechanical wear resistance, because the sensor performance is not impaired by wear or breaking of the fiber tips.

In the following, the invention is described in greater detail with the help of exemplifying embodiments illustrated in the appended drawings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1*a* shows a side view of a road surface condition sensor according to the invention;

FIG. 1*b* shows a detail of the sensor illustrated in FIG. 1*a;*

FIG. 2 is a top view of the sensor illustrated in FIG. 1;

FIG. 3 is a top view of a fiber layout according to the invention;

FIG. 4 is a top view of an alternative fiber layout according to the invention;

DETAILED DESCRIPTION OF THE PREFERRED EMBODIMENTS

Figure 5A:
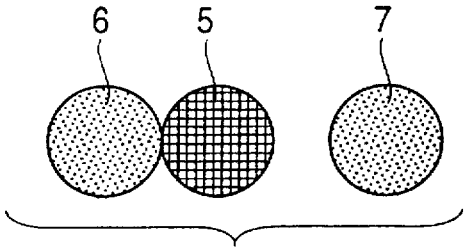
FIG. 5*a* is a top view of a third alternative fiber layout according to the invention.

Referring to FIGS. 1*a–b* and 2, the road surface condition sensor head 1 is shown therein mounted in the pavement 2 of a road so that the top surface of the sensor head 1 remains flush with the pavement layer 4. A temperature sensor 10 located flush with the bottom surface of the sensor head 1 is employed to measure the earth temperature, while similarly located flush with top of the sensor head 1 are a road surface temperature sensor 9, a black ice sensor 8 and an optical measurement sensor according to the invention comprising a sending fiber 5 and two receiving fibers 6 and 7. The sensor head 1 also includes a measurement facility of electrical conductivity and electrochemical polarization by means of electrodes for the determination of salinity and thickness of the overlying water layer. The optical thickness measurement according to the invention of the overlying water layer is based on the intensity dependence of the return signal, which is the optical signal coupled by reflection or backscatter from the overlying water layer 30 into the receiving fibers, on the thickness of the overlying water layer 30. Correspondingly, the detection of dry snow, slush and white ice is based on the strong backscatter of light by snow and white ice, whereby the output signal from the sensor head under such conditions has a significantly different amplitude from that obtained when the road is covered by a water film. The optical signal emitted from the sending fiber 5 is impinged from below on the layer covering the road surface, and the receiving fibers 6 and 7 serve for measuring optical return signal from the layer 30 overlying the pavement 4, typically reflected from the top surface of the overlying layer 30 or backscattered from the layer 30. In the context of the following text, the sending fiber 5 is also called the transmitter, while the receiving fibers 6 and 7 are also called the receivers, respectively. The dimensions of the exemplifying sensor head are 80×80×30 $mm^3$ (height×width×depth). The measurement control signals and required electric power are taken to the sensor head 1 via a cable 3, and also the sensor output signals are taken to the measurement system for further processing. The sensor head according to the invention typically uses two separate fibers or fiber bundles for optical signal reception. The thickness of the water layer 30 covering the pavement and the state of this layer are computed by algorithms which are separately affected by both the amplitudes of two measurement signals obtained in the above-described manner as well as the ratio of these signals. By measuring the water layer thickness as the ratio of the return signal amplitudes, the following benefits are attained: 1) aging of the radiant source is eliminated from affecting the measurement result, 2) temperature dependence of the measurement system is eliminated, 3) effect of fiber end scratching on the measurement result is eliminated, and 4) effect of impurities in the overlying water layer on the return signal is reduced. By complementing the signal ratio measurement with the monitoring of the absolute values of the return signals, incorrect signal interpretations caused by rubbish on the pavement are removed and also snow/slush on the road can be detected.

Referring to FIG. 3, the optical sensor fibers can be arranged into a cable of circular symmetry as shown therein, whereby the fiber bundle 14 located in the center is comprised by both light sending and receiving fibers bundled in a random order. The diameter of these fibers may be, e.g., 50 μm. The center area 14 of the bundle is first isolated by a narrow separating ring 13 and then surrounded by a ring 12 of formed by receiving fiber ends only. At its outer perimeter the receiving fiber ring 12 is enclosed by the protective jacket 11 of the optical fiber cable. Thus, the reflected signal obtained from the receiving fibers of the center area 14 can be made to reach its maximum amplitude at a water layer thickness which is much thinner than that giving the maximum output signals from the receiving fibers of the ring 12. This effect is attained by the sensor head design which causes the water layer thickness to modulate the average distance of the reflection/backscatter path from a sending fiber to a receiving fiber. By making the separating ring 13 wider, the output signal maximum from the fibers of the ring 12 can be shifted toward a thicker water layer. However, the absolute value of the signal is reduced, which may be compensated for by increasing the number of the receiving fibers. In a prototype design, the cross section of the center area 14 was 1.77 $mm^2$ and the cross section of the ring 12 was in the range 0.92–1.3 $mm^2$, respectively.

The optical power in this prototype design was launched into the sending fibers of the center area 14 from LED emitters operating at near-IR wavelengths. A suitable component for this purpose is Siemens SFH487P-2.

Referring to FIG. 4, the embodiment shown therein has a fiber bundl layout in which beside the fiber bundle 14 comprised of sending and receiving fibers is placed a fiber bundle 12 comprised of merely receiving fibers, whereby also this arrangement can provide two output signals each having a different response function on the water layer thickness.

Referring to FIG. 5*a*, the embodiment shown therein is characterized in that the output signals can be provided with two different response functions by placing a second receiving fiber 6 adjacent to the sending fiber 5 and then a second receiving fiber 7 apart from the sending fiber 5. In the prototype sensor head shown in FIG. 5*a* comprising single large-diameter fibers (dia. 1000 μm, for instance), the optical power was launched into the sending fiber 5 from a solid-state emitter type Siemens SFH45OV.

Figure 5B:
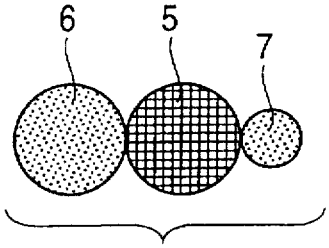
FIG. 5*b* is a top view of a fourth alternative fiber layout according to the invention.
Figure 9A:
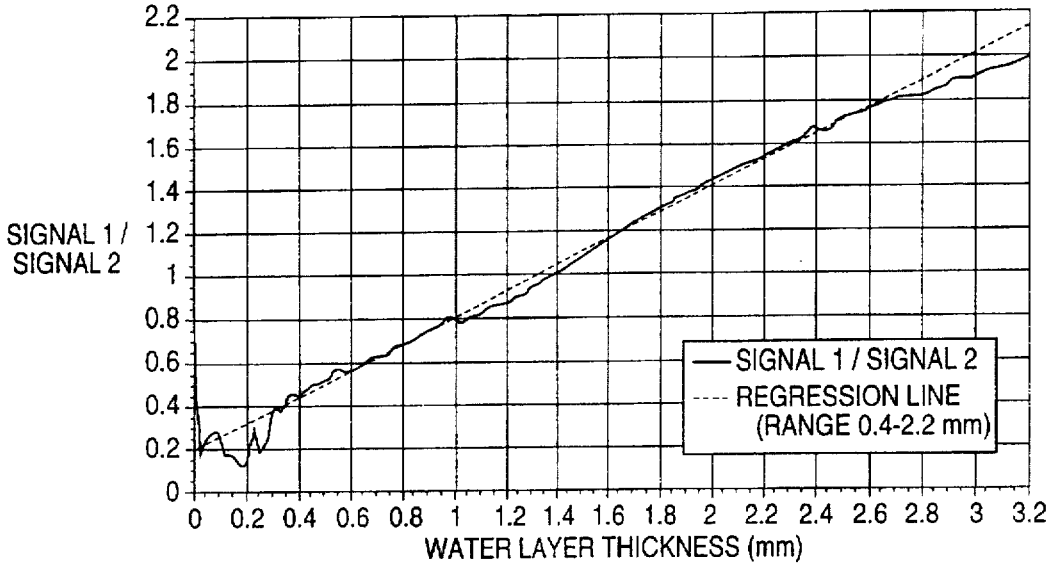
FIG. 9 is a graph illustrating the response function obtained by means of the fiber arrangement illustrated in FIG. 5*b*.
Figure 9B:
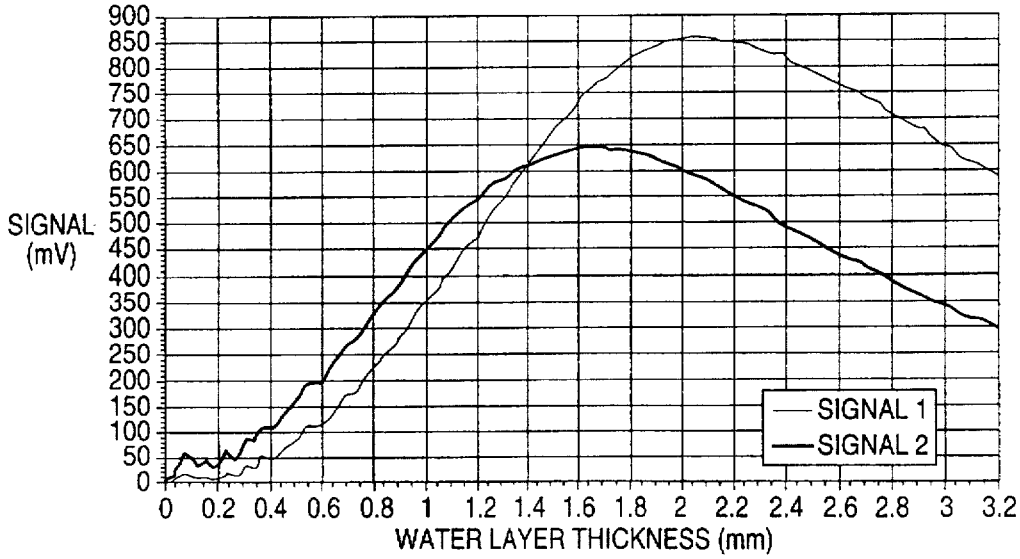

Referring to FIG. 5*b*, the embodiment shown therein is characterized in that the output signals can be provided with two different response functions by using two fibers 6 and 7 with different diameters so that the ratio of the fiber diameters is, e.g., approximately 1:2. Since this design makes the ratio of the output signals to increase as a linear function of the water layer thickness, the ratio measurement is easy to implement as shown in FIG. 9.

Figure 5C:
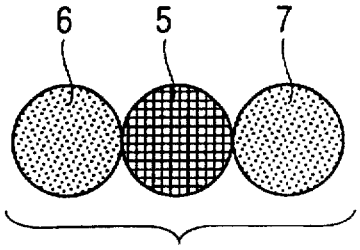
FIG. 5*c* is a top view of a fifth alternative fiber layout according to the invention.

Referring to FIG. 5*c*, the embodiment shown therein is characterized in that measurement signals can be provided with two different response functions by using two fibers 6 and 7 with different numerical apertures, that is, fiber input cones of different entry angles for receiving the optical signals. In the fiber layouts of both FIG. 5*b* and 5*c*, the receiving fibers 6 and 7 are located adjacent to the sending fiber 5.

In principle, each embodiment according to the invention can be implemented by replacing each of the individual large-diameter fibers with a fiber bundle having a diameter equal to that of the single fiber and the numerical apertures of the smaller-diameter fibers equal to that of each single fiber being replaced.

Figure 6:
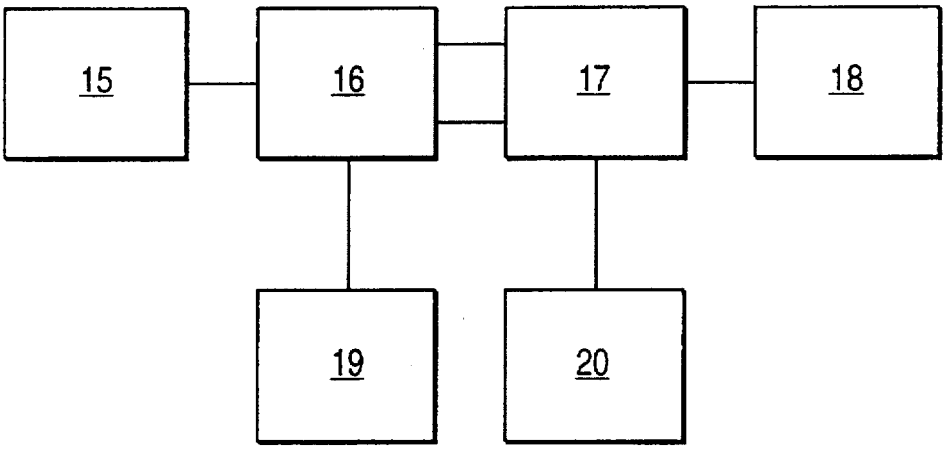
FIG. 6 is a block diagram of a measurement arrangement according to the invention.

As shown in FIG. 6, the sensor output signal from the sensor head 15 containing the fiber sensors is taken to the electronics circuitry 16 of the measurement apparatus to be described in greater detail later. The electronics circuitry is fed from a power supply 19 delivering the ±5 V operating voltages. The electronics circuitry 16 provides two analog output signals that are converted into digital format in a data acquisition unit 17. Operating voltages to the data acquisition unit are delivered by a power supply 20. The digitized measurement signals are transmitted over an RS-232 serial bus to a computer 18 that receives the measurement data and stores it into a desired file.

Figure 7:
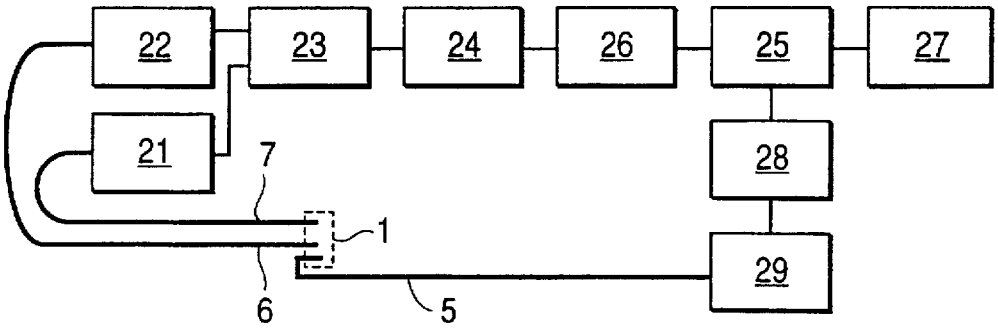
FIG. 7 is a block diagram of an electronic circuitry according to the invention.

Referring to FIG. 7, the electronics of the measurement apparatus is described in greater detail. The emitted radiation is coupled from the sending fiber or fiber bundle 5 to the receiving fibers 6 and 7 by reflection from the water-air interface or backscattering from white ice. The return signal thus obtained is rather weak requiring the use of modulation at a certain frequency on the emitted radiation, and correspondingly, necessitating filtration of the return signal in the receiver to eliminate the effect of noise caused by background radiation. The measurement circuitry can be implemented with the help of a phase-locked detector, for instance. In a practical test, a radiant power in the order of 100 μW could be coupled from radiant sources to a fiber bundle. Depending on the fiber type and length, the optical energy propagating in the fiber 5 up to the sensor head 1 (sender) is attenuated from this power level maximally a few tens of percent. Approximately two percent of the optical power reaching the water-air interface of the water layer being measured is reflected back to the water layer, and from this reflected optical power, about a tenth will be coupled into the end of the receiving fiber (receiver) or fiber bundle 6, 7 in the sensor head 1. From this level, the optical power is still attenuated both in the receiving fiber and the coupling interfaces between the fiber and the detector element. Hence, the power level of the optical return signal impinging on the radiation-sensing surface of the detector element is maximally in the order of tenths of a microwatt. Detecting such a weak signal under the background radiation conditions caused by direct sunshine necessitates bandpass filtration in the measurement system. In a preferred embodiment of the invention, such bandpass filtration was implemented by means of the above-mentioned phase-locked detector.

In a phase-locked measurement system, the measurement signal is amplitude-modulated using a sine-wave modulation envelope applied at a relatively high modulation frequency. During the reception of a noise-embedded signal, the signal components occurring at a frequency lower than the modulation frequency of the desired signal are cancelled by means of a high-pass filter connected after the first amplifier stage (which is operated as an AC amplifier). Next, the signal is taken to a product detector having a sinewave reference signal applied to its other input at the same frequency and phase-locked thereto as is used for modulation, after which the filtered measurement signal can be obtained from detector output signal by extracting the DC component with the help of a low-pass filter. Thus, noise is effectively cancelled, because such multiplication of the raw signal in product detector by the synchronized sinewave reference signal eliminates the effect of random-phase noise on the DC level of the signal. The modulation frequency in an exemplifying embodiment of the invention was selected as approx. 4.25 kHz, while the low-pass filtration was performed using a filter bandwidth of approx. 23.4 Hz, whereby no noise problems occurred in the signal detection.

The operation of the circuitry shown in FIG. 7 is outlined as follows: an oscillator block 28 is configured by combining an oscillator stage formed by an RC-connected inverter with a D-flip-flop, whose output then controls the emission 29 of the optical signal and the synchronization 25 of the product detector. The square-wave output signal of such an oscillator block 28 is extremely symmetrical which simplifies the generation of the reference signal and multiplication of the input signal in the product detector circuitry. The output level of the LED emitter in the sender block 29, that is, the current via the LED is determined by a controllable current source 29 formed by a transistor, two diodes and a resistor (max. input current of the LED being approx. 50 mA). The bias voltages of the PIN photodiodes 21 and 22 of the receiver block are taken from the operating voltage rails (±5 VDC) of the electronics circuitry (refer to block 19 in FIG. 6). The bandwidth of signal reception is determined by the RC time constant formed by the PIN photodiode capacitance and its load resistor to approx. 5.3 MHz. After the preamplifier stage 23, the signal is taken via a high-pass filter 24 formed by a capacitor and a resistor (having its 3 dB cutoff frequency at approx. 184 Hz) to the next amplifier stage 26. The product of the amplified signal with the synchronized reference signal is implemented with the help of circuit block 25 formed by an analog switch and an operational amplifier. The rising edge of the square-wave signal produced by the oscillator 28 simultaneously controls the LED input current on and the analog switch to a state passing the signal to both inputs of the operational amplifier. Then, the input signal is multiplied by logic one. Respectively, the falling edge of the square-wave signal produced by the oscillator 28 controls the LED input current off and the analog switch to a state taking the noninverting input of the operational amplifier to ground. Then, the input signal is multiplied by inverted logic one. As the input signal is thus multiplied into a positive DC signal, it can be separated from noise by means of a low-pass filter 27.

The selection of the electronics circuitry components was based on having the two first amplifier stages 23 and 26 maximally fast by their response, whereby they cannot distort the shape of the measurement signal. The operational amplifier in the product detector block 25 of signal need not have a fast response, but rather, it should have an offset voltage between its inputs as small as possible. This is because the amplifier offset voltage also causes an offset component in the measurement signal. Correspondingly, the analog switch should provide a fast switching time and a low leakage capacitances in the OFF state to assure correctly timed switch-over of the logic signal state at the multiplying input and to avoid large switching transients. Due to such switching problems of the multiplied signals in the product detector, the modulation frequency could not advantageously be made higher than 4.25 kHz.

Figure 8:
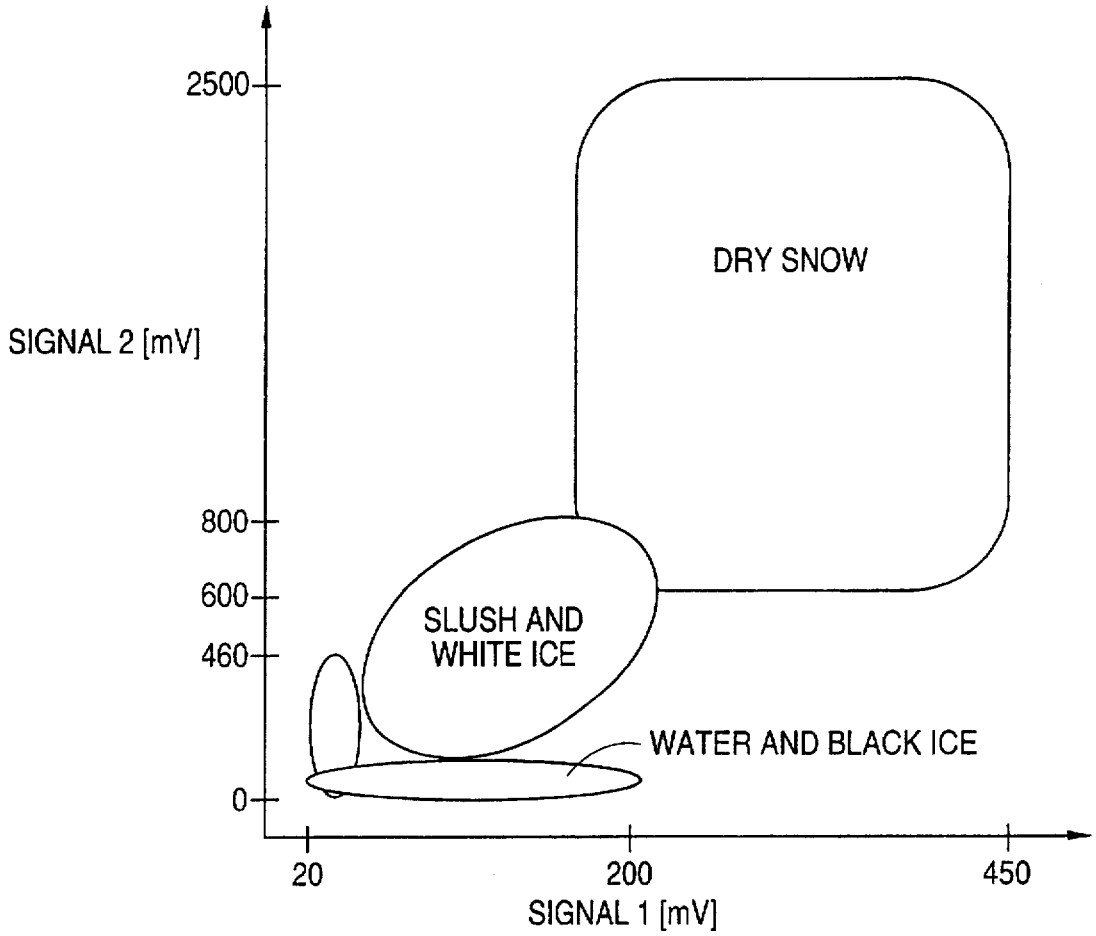
FIG. 8 is a graph illustrating the interpretation of measurement results obtained by means of a measurement apparatus according to the invention.

Now referring to FIG. 8, the interpretation of the road condition is made from the voltage levels of the two measurement signals. Signal no. 1 is typically taken from the receiving fibers bundled with the sending fibers or the receiving fibers closer to the sending fiber, while signal no. 2 taken from the outdistanced receiving fibers, respectively. In accordance with the response curve, the following interpretation of the exemplifying signal amplitude values can be made:

| Signal no. 1 | Signal no. 2 | Interpretation |
|---|---|---|
| 400 mV | 1000 mV | Dry snow |
| 150 mV | 460 mV | Slush or white ice |
| 10 mV | 200 mV | Water film or black ice |

Without departing from the scope of the invention, also three or a greater number receiving fibers or fiber bundles can be used.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of measuring conditions of a road surface comprising:

transmitting an optical signal from a fiber optic transmitter inside a sensor head through a medium outside the fiber optic transmitter adjacent the road surface, said sensor head being aligned substantially flush with the road surface;

receiving reflection and back scatter of the optical signal moving from a surface of and through the medium spaced apart from the road surface through the medium by a plurality of fiber optic receivers inside said sensor head; and calculating at least one of weather and driving conditions prevailing on the road surface from the reflected and back scatter optical signal received from said plurality of fiber optic receivers.

2. The method as defined in claim 1, wherein said transmitting and receiving steps further comprise:

transmitting the optical signal to the road surface by a circularly symmetrical optical fiber bundle and receiving reflection and back scatter of the optical signal from the surface of the medium spaced apart from the road surface by the circularly symmetrical optical fiber bundle, said bundle mounted in said sensor head.

3. The method as defined in claim 1, wherein the transmitting and receiving steps further comprise:

transmitting the optical signal to the road surface by a first optical bundle and receiving reflection and back scatter of the optical signal from the surface of the medium spaced apart from the road surface by an adjacently placed second optical fiber bundle.

4. The method as defined in claim 1, wherein the transmitting and receiving steps further comprise:

transmitting the optical signal to the road surface by a single optical fiber and receiving reflection and back scatter of the optical signal from the surface of the medium spaced apart from the road surface by at least two single adjacently placed optical fibers.

5. The method as defined in claim 1, wherein the receiving step further comprises:

receiving the optical signal from the surface of the medium adjacent the road surface by optical fibers or fiber bundles having diameters different from each other.

6. The method as defined in claim 1, wherein the receiving step further comprises:

receiving the optical signal from the surface of the medium adjacent the road surface by optical fibers or fiber bundles having numerical apertures different from each other.

7. The method as defined in claim 1, wherein said calculating step further comprises:

using an AC amplitude-modulated measurement signal detected by phase-locked methods.

8. An apparatus for measuring the conditions of a road surface, said apparatus comprising:

a sensor head mounted in pavement material beneath the road surface with a surface of the sensor head aligned substantially flush with the road surface, said sensor head includes at least one fiber-optic transmitter emitting an optical signal from below the road surface and through a medium adjacent to the road surface, the medium including a surface spaced apart from the road surface, said sensor head further includes at least two fiber-optic receivers receiving the optical signal reflected or back scattered from the surface of the medium spaced apart from the road surface.

9. The apparatus as defined in claim 8, wherein at least one of said transmitter and receivers includes an optical fiber bundle with concentrically arranged fibers which enclose each other.

10. The apparatus as defined in claim 8, wherein said transmitter includes a fiber optic bundle and said receivers include a fiber optical bundle, said transmitter is disposed adjacent to said receiver.

11. The apparatus as defined in claim 8, wherein said transmitter includes a single optical fiber and said receivers include two single optical fibers, said transmitter is disposed adjacent to said receiver.

12. The apparatus as defined in claim 8, wherein said transmitter and receiver are made of a material that wears at a substantially similar rate with wear of the sensor head and the road surface without impairing the function of the sensor head.

13. The apparatus as defined in claim 8, said apparatus further comprises a phase lock detector.

14. The apparatus as defined in claim 8, wherein said transmitter includes a single optical fiber having a first diameter, said receivers include two single optical fibers having second and third diameters, said first and second and third diameters are substantially equal, the receiving single optical fiber with the second diameter is disposed adjacent to said transmitting single optical fiber with the first diameter, said receiving single optical fiber having the third diameter is spaced apart from said transmitting single optical fiber.

15. The apparatus as defined in claim 8, wherein said transmitter includes a single optical fiber with a first diameter, said receivers include two single optical fibers having second and third diameters, said transmitting single optical fiber is disposed between said receiving optical fibers.

16. The apparatus as defined in claim 8, wherein the transmitter includes a single optical fiber with a first diameter, said receivers include a single optical fiber with a second diameter and a single optical fiber with a third diameter, said transmitting optical fiber is disposed between the receiving second and third optical fiber, said first and second and third diameters are substantially equal.

* * * * *